US011866920B2

(12) United States Patent
Kappus et al.

(10) Patent No.: US 11,866,920 B2
(45) Date of Patent: Jan. 9, 2024

(54) FLUSH VALVE ASSEMBLY

(71) Applicant: AS America, Inc., Piscataway, NJ (US)

(72) Inventors: Steven D. Kappus, Manville, NJ (US); Behnam Heydari, Ridgewood, NJ (US); Mahendra Gunawardena, Hillsborough, NJ (US); Verne H. Myers, Fort Wayne, IN (US); Niloy Talukder, San Jose, CA (US); Nitin S Kolekar, Piscataway, NJ (US); Eric B. Soberano, Barnegat, NJ (US)

(73) Assignee: AS America, Inc., Piscataway, NJ (US)

( * ) Notice: Subject to any disclaimer, the term of this patent is extended or adjusted under 35 U.S.C. 154(b) by 9 days.

(21) Appl. No.: 17/253,021

(22) PCT Filed: Jun. 24, 2019

(86) PCT No.: PCT/US2019/038648

§ 371 (c)(1),
(2) Date: Dec. 16, 2020

(87) PCT Pub. No.: WO2020/005795

PCT Pub. Date: Jan. 2, 2020

(65) Prior Publication Data

US 2021/0115652 A1 Apr. 22, 2021

Related U.S. Application Data

(60) Provisional application No. 62/691,283, filed on Jun. 28, 2018.

(51) Int. Cl.

| | |
|---|---|
| ***E03D 1/34*** | (2006.01) |
| ***E03D 5/092*** | (2006.01) |
| ***E03D 5/10*** | (2006.01) |

(52) U.S. Cl.
CPC ..... *E03D 1/34* (2013.01); *E03D 5/092* (2013.01); *E03D 5/10* (2013.01)

(58) Field of Classification Search
CPC .. E03D 1/34; E03D 5/10; E03D 1/308; E03D 1/142; E03D 1/306; E03D 5/105
See application file for complete search history.

(56) References Cited

U.S. PATENT DOCUMENTS 6,006,371 A * 12/1999 Korte ..... E03D 1/34 4/391
6,728,975 B2 * 5/2004 Han ..... E03D 1/34 4/324

(Continued)

FOREIGN PATENT DOCUMENTS

CN 2128262 Y 3/1993
CN 203769023 * 8/2014 ..... E03D 1/34

(Continued)

OTHER PUBLICATIONS

International Search Report dated Aug. 29, 2019 in corresponding International Application No. PCT/US2019/038648(2 pages).

*Primary Examiner* — David P Angwin
*Assistant Examiner* — Nicholas A Ros
(74) *Attorney, Agent, or Firm* — Tyler A. Stevenson; Anna-lisa L. Gallo

(57) ABSTRACT

A flush valve assembly comprising a flush valve comprising a flush valve body extending from a flush valve inlet to a flush valve outlet; a flush valve seal having a top face and a bottom face; and a flush actuator comprising a rigid linkage; wherein the bottom face of the flush valve seal is configured to enclose the flush valve inlet; and wherein the rigid linkage is coupled to the top face of the flush valve seal and is configured to lift the flush valve seal to open the flush valve and to lower the flush valve seal to close the flush valve. A (Continued)

rigid linkage is configured to lift a flush valve seal and to lower a flush valve seal at a controlled rate.

17 Claims, 8 Drawing Sheets

(56) References Cited

U.S. PATENT DOCUMENTS

| | | | | |
|---|---|---|---|---|
| 9,657,471 | B2 * | 5/2017 | Denzin | E03D 1/142 |
| 9,695,581 | B2 * | 7/2017 | Shinohara | E03D 1/34 |
| 10,370,836 | B2 * | 8/2019 | Breed | E03D 1/34 |
| 2005/0076425 | A1 | 4/2005 | Contadini | |
| 2005/0217012 | A1 * | 10/2005 | Peng | E03D 1/142 4/325 |
| 2006/0041999 | A1 * | 3/2006 | Sanderson | E03D 1/18 4/378 |
| 2006/0248638 | A1 | 11/2006 | Diethelm | |
| 2013/0219606 | A1 | 8/2013 | Kohler | |

FOREIGN PATENT DOCUMENTS

| | | | |
|---|---|---|---|
| CN | 203769023 | U | 8/2014 |
| CN | 203769023 | U | 8/2014 |
| CN | 204385833 | U | 6/2015 |

* cited by examiner

FLUSH VALVE ASSEMBLY

The present invention relates to flush valve assemblies. In some embodiments, the present invention relates to electronic flush valve assemblies including controlled flush valve actuation.

BACKGROUND

Toilets often employ floats to assist in opening and closing a flapper of a flush valve. The use of a float does not provide reliable flapper control such as flapper descent control upon flush completion and/or flapper ascent control upon flush initiation. Float elevation relative to a flapper controls water consumption during a flush cycle. Limited and unreliable float control can result in increased water consumption and poor flush performance.

A need continues to exist for a flush valve assembly with reliable and controllable operation, including features that can reliably control operation of a flush valve seal including an ascent and descent of a flapper or flush valve seal.

SUMMARY

In an embodiment, disclosed is a flush valve assembly comprising a flush valve comprising a flush valve body extending from a flush valve inlet to a flush valve outlet; a flush valve seal having a top face and a bottom face; and a flush actuator comprising a rigid linkage; wherein the bottom face of the flush valve seal is configured to enclose the flush valve inlet; and wherein the rigid linkage is coupled to the top face of the flush valve seal and is configured to lift the flush valve seal to open the flush valve and to lower the flush valve seal to close the flush valve.

In some embodiments, a rigid linkage is configured to lift a flush valve seal and to lower a flush valve seal at a controlled rate. In some embodiments, a rigid linkage is configured to open a flush valve for a certain time interval to provide a certain flush volume. A flush valve assembly may be associated with a controller (microcontroller or printed circuit board). A controller may communicate a signal to an electronic device associated with a flush actuator. An electronic device may be an electric motor or a solenoid valve. A controller may comprise logic to send instructions regarding certain time intervals, certain flush volumes, certain lift or lower rates, etc.

In certain embodiments, the flush actuator is associated with an electric motor, a solenoid valve, a hydraulic cylinder, a pneumatic cylinder, a piston, or a combination thereof. The rigid linkage is configured to open and close the flush valve in a controlled manner.

BRIEF DESCRIPTION OF DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
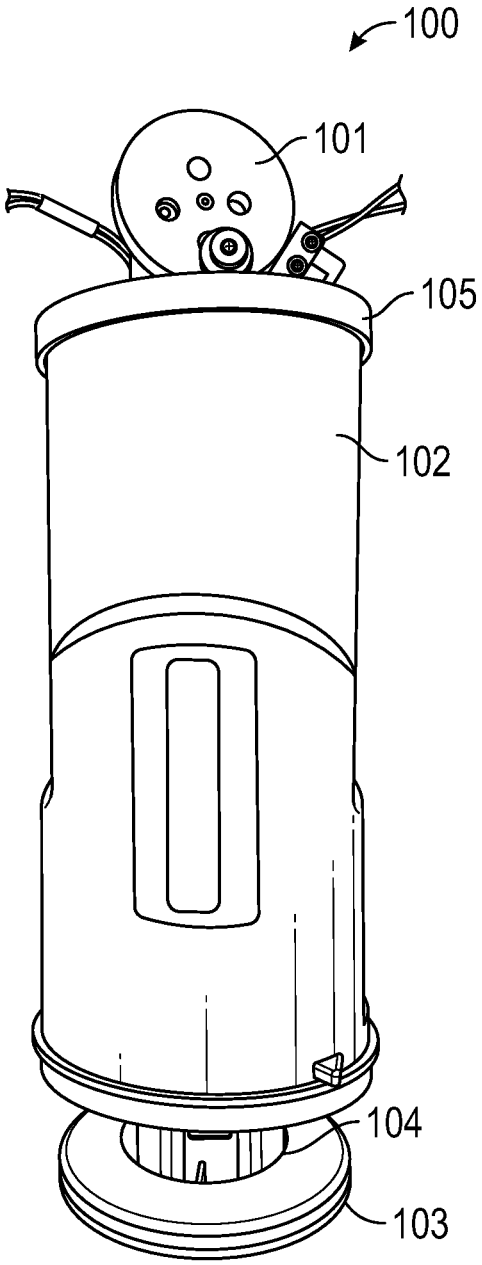
FIG. 1 depicts a flush valve assembly portion, according to an embodiment.

According to an embodiment, a flush valve assembly for a toilet may include a flush valve configured to couple to a toilet tank outlet, a flush valve assembly including a flush valve body; a flush valve seal; an actuator; a controller (microcontroller or printed circuit board); and an electric motor associated with a motor wheel.

In an embodiment, a rigid linkage is configured to rotate around a circular path along with the motor wheel, the rotation resulting in opening and closing of the flush valve at a predetermined rate. A predetermined rate may be part of the logic of the controller. A controller may be configured to rotate a motor wheel 360 degrees and fractions thereof. A fraction of a 360 degree rotation or of a 180 degree rotation may be termed a "degree interval".

In some embodiments, a rigid linkage may be substantially perpendicular with a flush valve seal top face. This may mean wherein a flush valve seal is in a closed position, an open position, or at any position between. In some embodiments, wherein a rigid linkage comprises a multi-arm linkage, this may mean the entire multi-arm linkage may be substantially perpendicular with a flush valve seal top face, or a portion of a multi-arm linkage may be substantially perpendicular with a flush valve seal top face.

A motor wheel may have a 12 o'clock position corresponding to a fully open flush valve and a 6 o'clock position corresponding to a full closed flush valve. A motor wheel may have an intermediate position between a 12 o'clock and a 6 o'clock position, corresponding to a partially-open flush valve, the intermediate position corresponding to a fraction of an o'clock position. In some embodiments, a controller may be configured to move a motor wheel a degree interval to control a volume of fluid flowing through a flush valve.

In some embodiments, a user may choose for instance a "full flush" of about 1.6 gallons (about 6 liters) of water to eliminate solid waste or a "partial flush" (short flush) of a lower volume or water, for example about 1.1 gallons (about 4 liters), for the removal of liquid waste. Multiple flush volumes are described for example in US2010/0043130 and U.S. app. No. 62/691,283.

In some embodiments, a flush valve seal may not be coupled to a flush valve chain. Rotation of a motor wheel may result in longitudinal movement of a flush valve seal. A circular path and a perimeter of a motor wheel may be concentric. A rigid linkage may move in a same direction as a motor wheel.

According to an embodiment, an actuator for a flush valve assembly may include a motor wheel having a perimeter and opposing sides, the motor wheel coupled to a motor; a rigid linkage coupled to one of the opposing sides of the motor wheel, the rigid linkage configured to rotate with the motor wheel; and a controller configured to actuate the motor to rotate the motor wheel and linkage to open and close a flush valve. A linkage may be configured to travel along a path around a perimeter of a motor wheel.

An actuator may include a triggering mechanism, the triggering mechanism comprising an input activated by a user, wherein the input sends a signal to a controller, a signal corresponding to instructions to at least one of open, close, partially-open, and partially-close a flush valve. A triggering mechanism may comprise a button, a lever, a handle, a knob, etc.

A controller may be in electrical communication with an electric motor and a triggering mechanism. Electrical communication may be via a wire or may be wireless.

In some embodiments, a rigid linkage may comprise a multi-arm linkage. A multi-arm linkage may comprise one or more joints configured to allow for some movement around the joints. Movement may be side-to-side and/or up-and-down. A multi-arm linkage may comprise slotted elements adapted to allow for movement, for example a sliding or a flex motion of one or more arms. Arm elements may be coupled for example via a slot-and-pin attachment. A multi-arm linkage may include a vertical extending portion coupled to a split portion, a split portion coupled to a cylindrical extension having two horizontal extensions, the two horizontal extensions configured to couple to a connecting member of a flush valve seal. In certain embodiments, a rigid linkage may be fixedly coupled to a motor wheel.

According to another embodiment, a flush valve assembly for a toilet may include a flush valve configured to couple to an outlet in a toilet tank, the assembly comprising a flush valve body; a flush valve seal; an actuator; a piston associated with the actuator; a solenoid valve in flow communication with the piston; and a controller, the controller configured to open a solenoid valve to provide pressurized air or fluid to the piston to open a flush valve and configured to close a solenoid valve to relieve pressure from the piston to a toilet tank to close a flush valve.

In some embodiments a flush valve assembly may include a first solenoid valve, a second solenoid valve, and a third solenoid valve. A first solenoid valve may be in flow communication with a flush valve with a first tubing and in flow communication with a toilet tank with a second tubing, wherein pressurized air or fluid is provided through a first tubing and relieved through a second tubing. A second solenoid valve may be in flow communication with a second flush valve with a third tubing and in flow communication with a toilet tank with a fourth tubing, wherein pressurized air or fluid is provided through a third tubing and relieved through a fourth tubing. A third solenoid valve may be in flow communication with a toilet tank with a fifth tubing, a fifth tubing configured to refill a toilet tank after a flush cycle.

An outlet of each solenoid valve may be in flow communication with a respective vacuum breaker and an inlet of each solenoid valve may be in flow communication with a water supply line. A flush valve assembly may comprise a solenoid tree comprising a plurality of solenoid valves. A solenoid valve may be in flow communication with a piston via a tube.

According to an embodiment, a flush valve assembly for a toilet comprises a solenoid tree comprising a first solenoid valve and a second solenoid valve; a first piston in flow communication with a first solenoid valve via a first tubing; and a controller configured to open and close a first solenoid valve to open and close a first flush valve and configured to open and close a second solenoid valve to refill a water level in a toilet tank.

An actuator may include a third solenoid valve in flow communication with a second piston via a third tubing, wherein a controller is configured to open and close a third solenoid valve to open and a close a second flush valve.

In some embodiments, a first flush valve may be a jet flush valve and a second flush valve may be a rim flush valve. The jet flush valve may provide fluid from a toilet tank through a jet path to a sump area of a toilet bowl and a rim flush valve provides fluid from a toilet tank through a rim path to a rim of a toilet bowl.

A second solenoid valve may be in flow communication with a toilet tank to refill a toilet tank with water after a flush cycle.

An assembly may include a plurality of fastening members for securing a first solenoid valve and second solenoid valve to a solenoid housing of a solenoid tree. The plurality of fastening members may be valve blocks.

According to an embodiment, a method for flushing a toilet with an electrical signal may include activating a button (or knob or handle, etc.) on a toilet, the button in electronic communication with a controller; the controller sending a signal to an electric motor to rotate a motor wheel coupled to a rigid linkage in a first direction; raising the rigid linkage to move a flush valve seal longitudinally upward and off a sealing surface of an outlet in a tank; discharging a fluid in a tank to a toilet bowl; and sending a signal to a flush valve actuator to rotate a motor wheel in a second direction opposite the first direction to move the flush valve seal longitudinally downward and onto a sealing surface of the outlet in the tank to stop discharging a fluid in the tank to the toilet bowl.

According to an embodiment, a method for flushing a toilet with an electrical signal may include activating a button on a toilet, the button in electronic communication with a controller; the controller sending a signal to a solenoid valve on a solenoid tree to move a piston with a pressurized air or fluid; moving a flush valve seal longitudinally upward and off a sealing surface of an outlet in a tank due to a pressurized air or fluid; and discharging air or fluid in a tank to a toilet bowl.

The present invention relates to flush valve assemblies, and in some embodiments, to electro-mechanical flush valve assemblies. This flush valve assembly can be referred to as "flushed with electronics" (wired or wireless), such as an electro-mechanical flush system. A flush valve assembly may be configured to reliably control an operation of a flush valve seal including ascent and descent of a seal.

Various implementations of a flush valve assembly are contemplated. One exemplary flush valve assembly is a flush valve rigidly connected to an electric motor(s) to control an ascent and descent of a flush valve seal. Another exemplary flush valve assembly uses energy stored in water or air pressure and solenoid valves to actuate a flush valve assembly. In an embodiment of a solenoid valve system, water or air pressure fills cylinders attached to each flush valve(s). As a cylinder is filling, it lifts a seal in a flush valve to allow water to enter a port or ports on a toilet. Flow of water or air into a cylinder may be regulated to lift/ascend a flush valve seal at a predetermined rate of speed. Flow of water or air may be used to slowly descend a flush valve seal at a controlled rate.

Referring to FIG. 1, shown is an embodiment of a flush valve assembly portion 100 comprising a flush valve actuator (not visible) associated with an electric motor (not visible) and a motor wheel 101. A rigid multi-arm linkage (not visible) is disposed in tubular guide element 102. Flush valve seal 103 is coupled to motor wheel 101 via a rigid multi-art linkage and connection feature 104. The electric motor is fixed to plate 105 on a top end of guide element 102. A rigid linkage is considered "disposed in" a guide element, even if only partially disposed therein.

In this embodiment, the tubular guide element is cylinder-shaped and the flush valve seal is circular-shaped. The flush valve seal is configured to enclose a circular-shaped flush valve. In other embodiments, a flush valve, flush valve seal or guide element may have other shapes, for example triangular, rectangular, square, oval, oblong, ovate, elliptic, obovate, cuneate, deltoid or orbicular. This may mean a surface of or a cross-section thereof may have a certain shape.

Figure 2B:
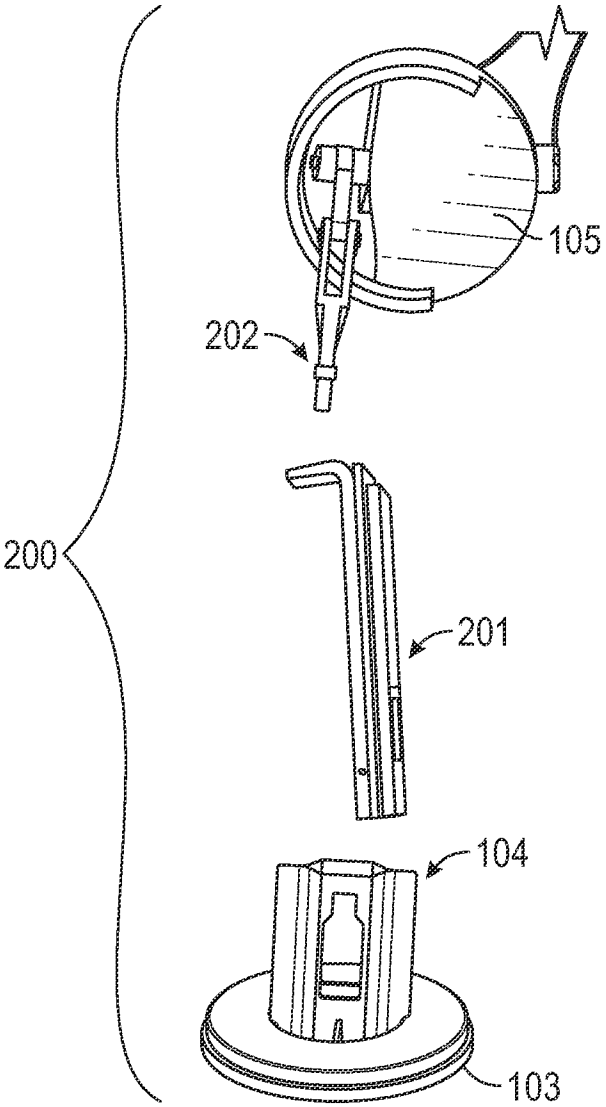
FIG. 2*a* and FIG. 2*b* show an exploded view of a flush actuator, according to an embodiment.
Figure 2A:
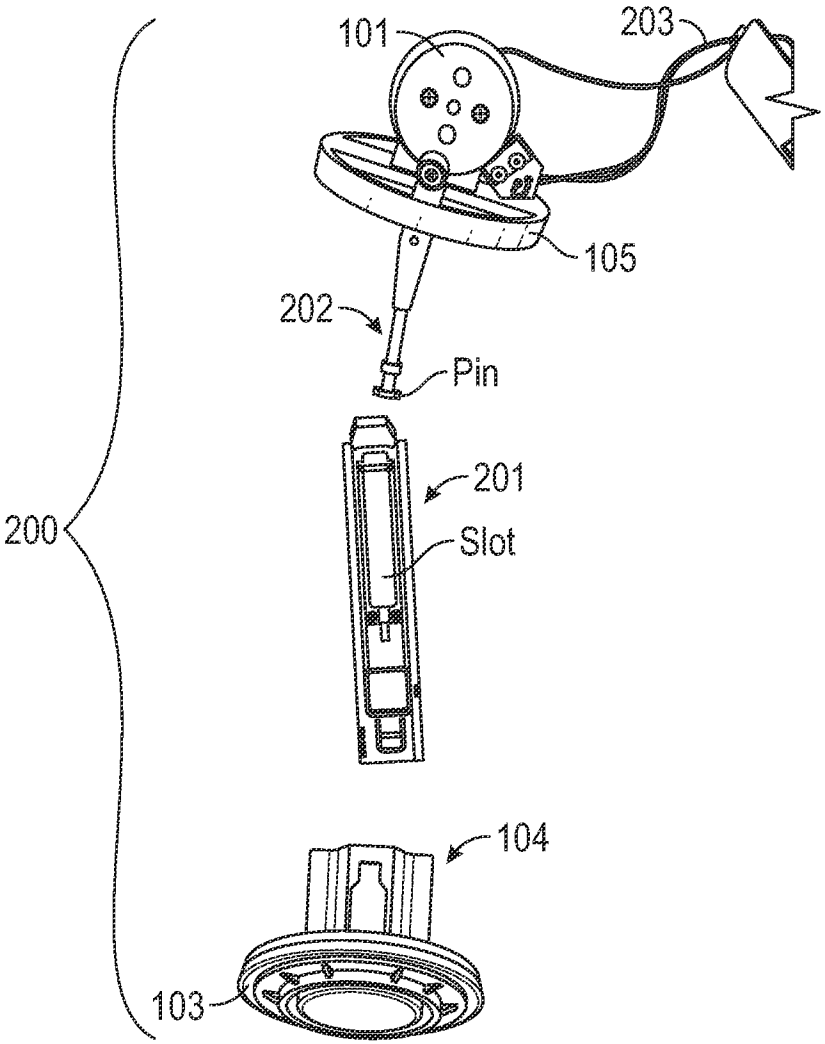

FIG. 2*a* and FIG. 2*b* depict an exploded view of a flush actuator 200 comprising a multi-arm linkage disposed in a tubular guide element of FIG. 1, according to an embodiment. The multi-arm linkage comprises connection feature 104, slotted arm 201, and rotating slotted arm 202. Connection feature 104 is fixed to flush valve seal 103. Rotating slotted arm 202 is coupled to motor wheel 101 and will rotate as the motor wheel is rotated. The multi-arm linkage is connected via slot-and-pin elements. Visible are electric wires 203 in electronic communication with an electric motor (not visible) fixed to plate 105.

Figure 3:
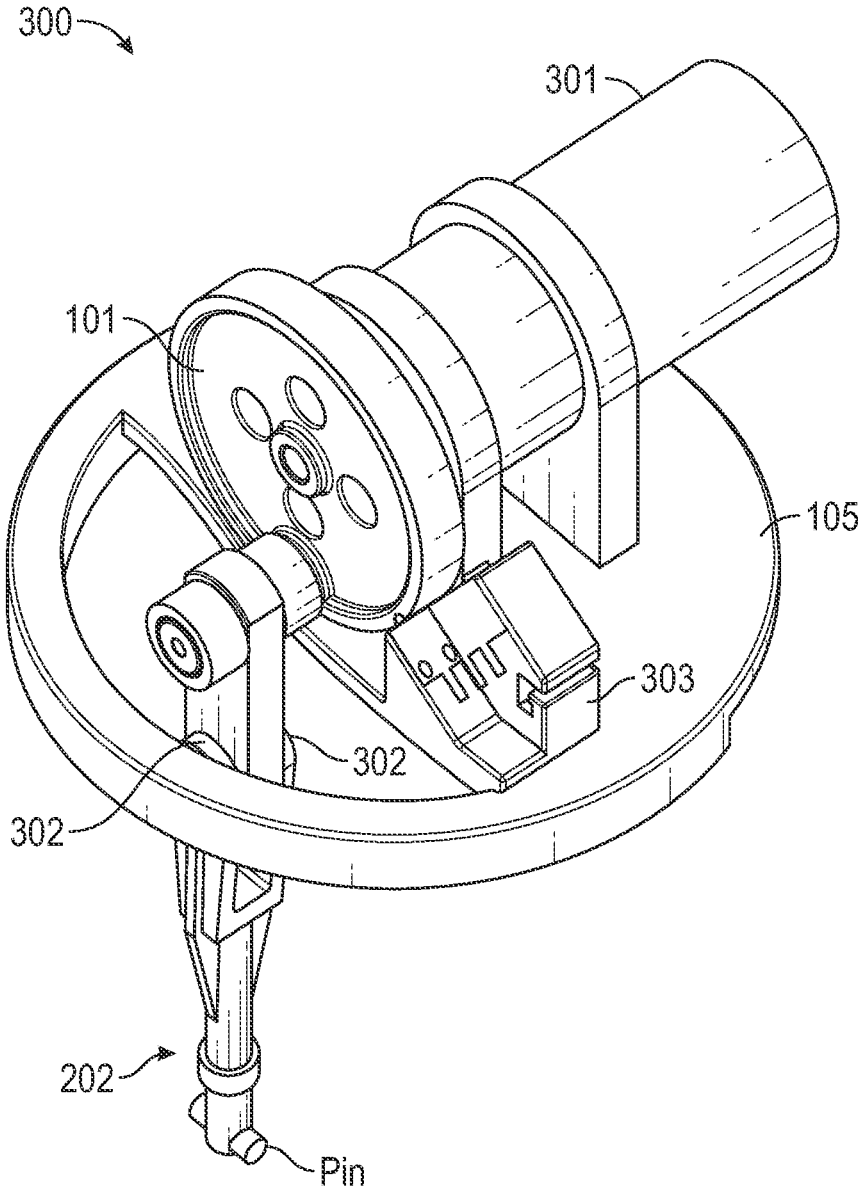
FIG. 3 depicts a perspective view of a flush valve assembly portion, according to an embodiment.

FIG. 3 depicts a portion 300 of a flush valve assembly comprising an electric motor suitable for use in assemblies of FIG. 1, FIG. 2*a*, and FIG. 2*b*, according to an embodiment. Shown is electric motor 301 fixed to plate 105 and coupled to motor wheel 101. Motor wheel 101 is coupled to rotating slotted arm 202 via joints 302 configured to allow movement of arm 202 with the motor wheel. As the electric motor turns the motor wheel, arm 202 will move with it, lifting or lowering a flush valve seal (not shown). Motor 301 may be in electronic communication with a controller via switch 303. A controller may communicate may communicate "on", "off", "rate of ascent", "rate of descent", "number of degrees of rotation", "degree interval", "time interval", "time of rotation", etc. to the switch.

Figure 4C:
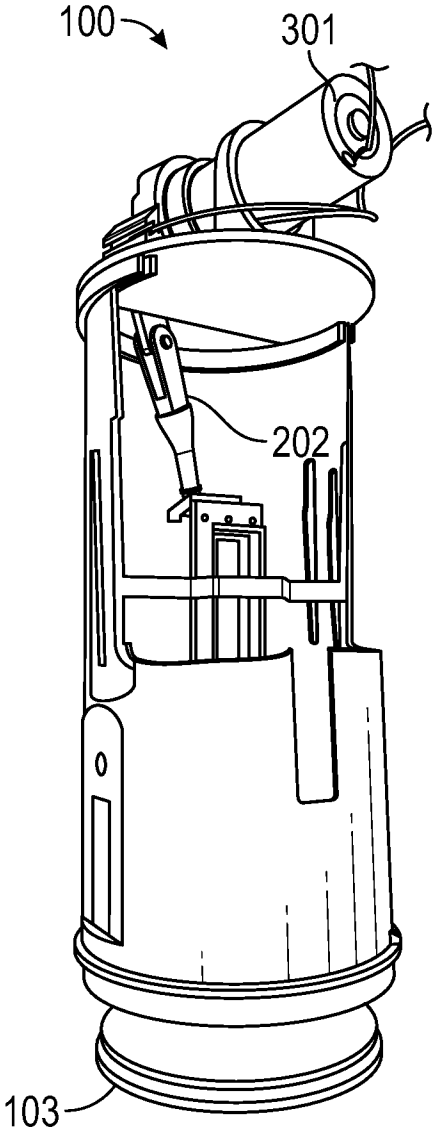
FIG. 4*a*, FIG. 4*b*, and FIG. 4*c* show a partial cut away view of a flush valve assembly portion, according to an embodiment.
Figure 4B:
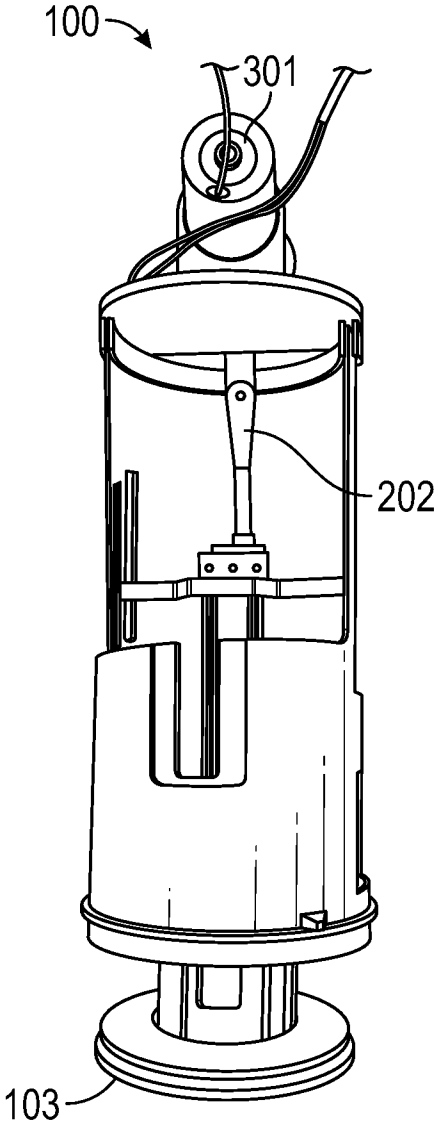
Figure 4A:
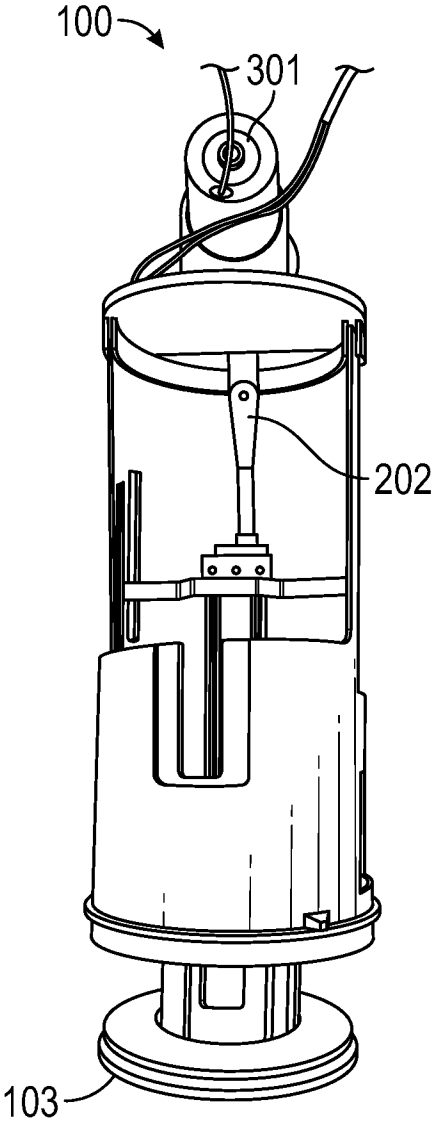

FIG. 4*a*, FIG. 4*b* and FIG. 4*c* show a flush valve assembly portion 100, each having flush valve seal 103 in a different position. The assembly portion 100 is of a view wherein electric motor 301 is visible. A portion of tubular guide element 102 is cut away, allowing rotating slotted arm 202 to be visible. In FIG. 4*a*, the motor wheel (not visible) will be in a 6 o'clock position, slotted arm 202 will be at a lowest point, and flush valve seal 103 will be in a position to close a flush valve (not shown). In FIG. 4*b*, the motor wheel is rotated a degree interval to partially rotate and lift slotted arm 202 and to partially lift flush valve seal 103. In FIG. 4*c*, rotating slotted arm is lifted to about a 3 o'clock position, which in this embodiment may represent a fully lifted flush valve seal 103 and a fully opened flush valve. From this position, the flush valve seal 103 may be lowered in a controlled manner after a predetermined (programmed) time interval. Flush valve seal 103 may be lifted and lowered at a programmed rate over a programmed time interval so as to control a flush volume and flush performance.

Fine and precise control may be achieved through controlling a speed of a motor wheel through electrical timing software. In some embodiments, a controller may control a motor/motor wheel such that certain degrees or degree intervals may correspond to a varied rotation rate. For example, from 10 o'clock to 12 o'clock, a motor wheel may have a rate of about 100 rpm and between 12 o'clock and 2 o'clock, a rate of about 225 rpm. In some embodiments, a motor wheel may have a rotation rate of from 0 rpm to about 225 rpm. Accordingly, a speed of a motor may be faster at some locations depending on a motor wheel position.

Incremental control of a motor wheel and thus a flush valve, may allow for selected quantities or volumes of water to flow from a tank to a toilet bowl. For example, an incremental control may allow for a toilet to have selected volume discharges such as for full flush, partial flush, liquid waste flush, solid waste flush, cleaning cycle, deodorizing cycle, etc. The quantity or volume of fluid that is discharged from a tank to a bowl may be finely or precisely controlled. That is, an incremental change in a motor wheel may effectuate a volume change down to liter, gallon, quart, cup, or fractions thereof.

Figure 5:
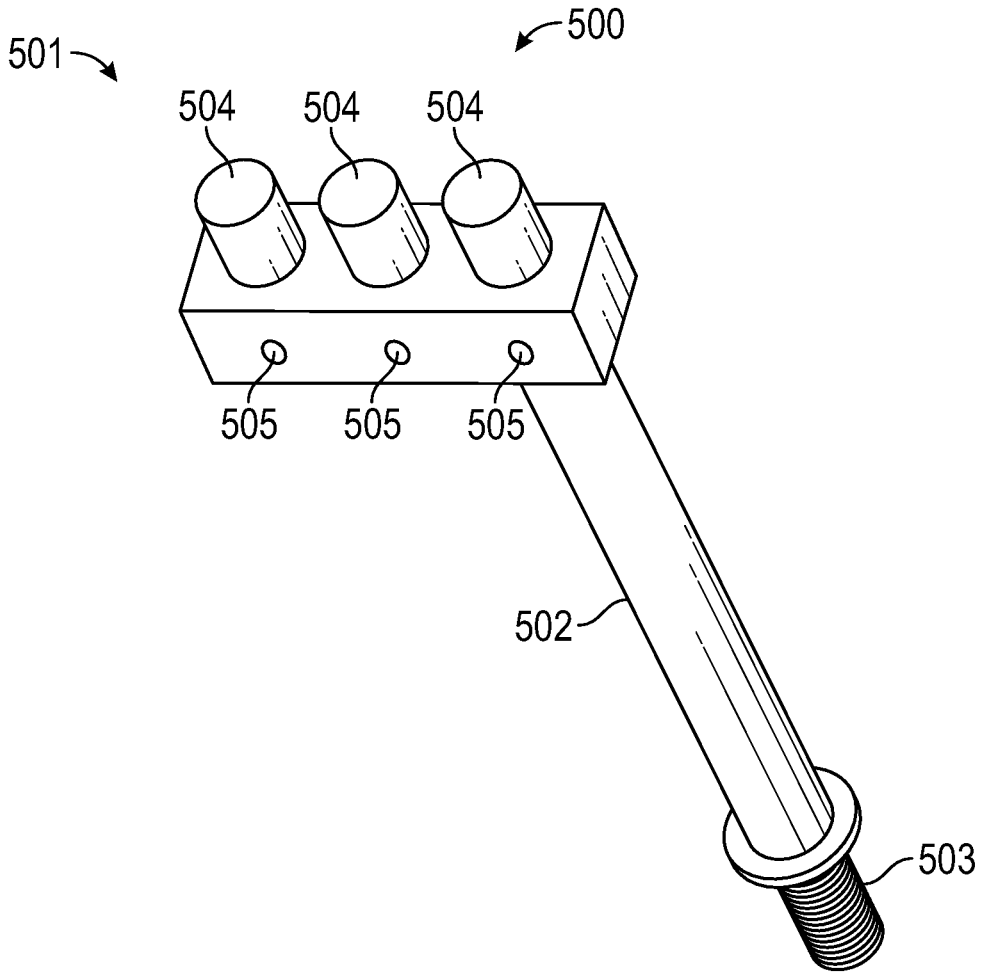
FIG. 5 shows a perspective view of a solenoid tree for an electro-mechanical flush valve assembly, according to an embodiment.

FIG. 5 depicts a solenoid tree 500. Solenoid tree 500 may include a manifold 501 and a cylindrical, hollow tube portion or inlet tube 502. Inlet tube 502 may include a threaded portion 503 on an opposing side of a flange configured to couple to an opening (not depicted) in a toilet tank. Manifold 501 may be coupled to one or more solenoid valves 504. Manifold 501 may include one or more openings 505 aligned with one or more solenoid valves 504. One or more openings 505 may be above a maximum water level in toilet tank and above a top of an overflow tube. One or more openings 505 may receive a fitting that may connect to tubing. A vacuum breaker may be located upstream of a fitting. Manifold 501 may have a width of about 127 mm (about 5.0 inches). Solenoid tree 500 may have an overall height of about 355 mm (about 14.0 inches). Inlet tube 502 may be mounted off center from a center of manifold 501. Inlet tube 502 may be aligned with third solenoid valve 504. Inlet tube 502 may allow fluid to flow through solenoid tree 500 and into solenoid valves 504.

Figure 6A:
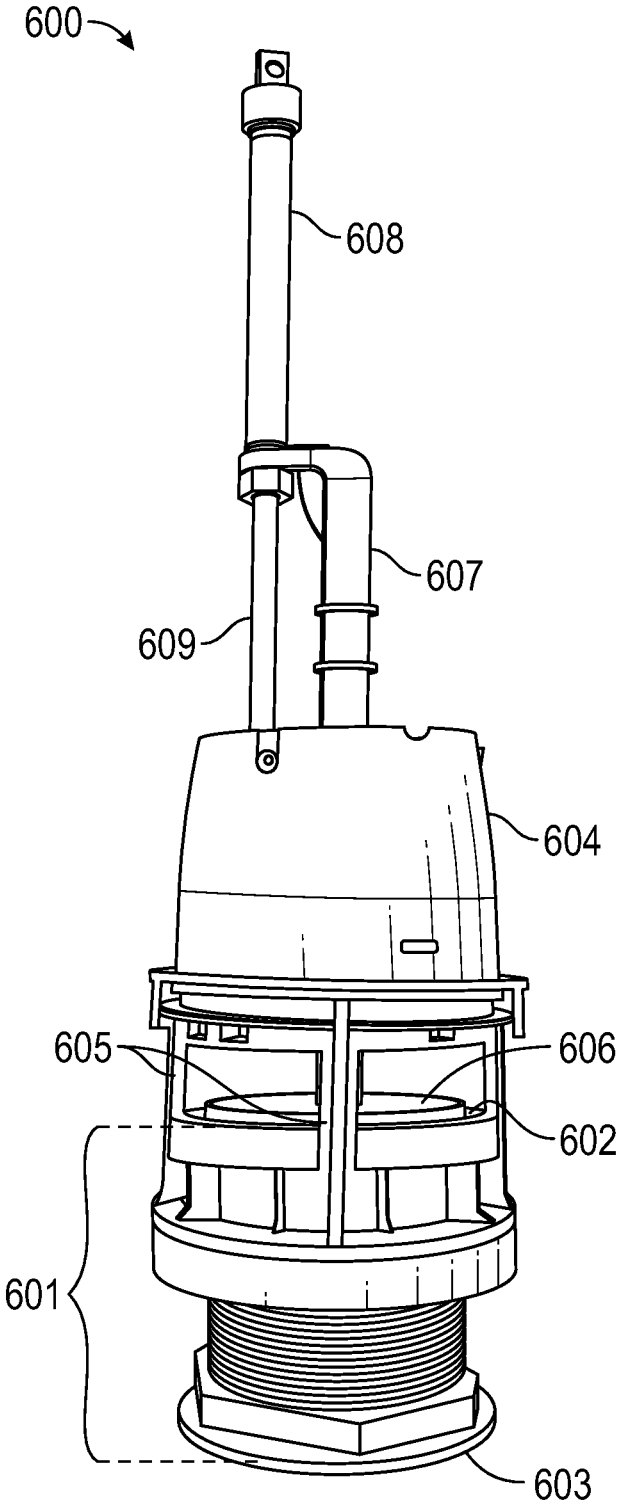
FIG. 6*a* and FIG. 6*b* show a flush valve assembly, according to an embodiment.
Figure 6B:
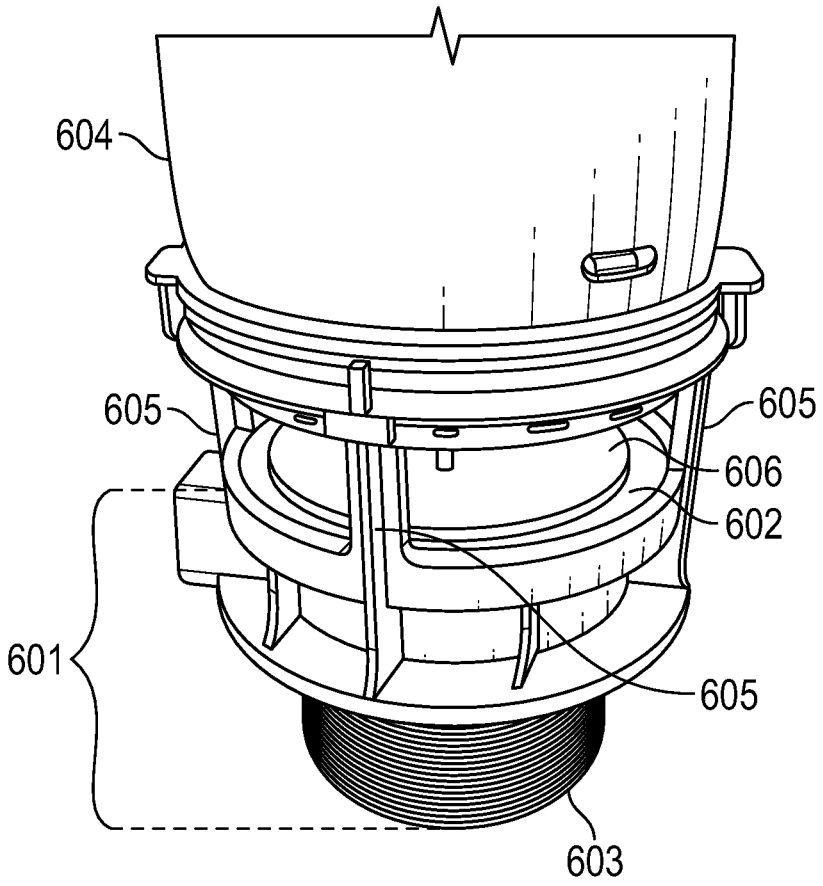

FIG. 6*a* and FIG. 6*b* show a flush valve assembly 600 comprising a flush valve body 601 extending from a flush valve inlet 602 to a flush valve outlet 603. A tubular guide element 604 is coupled to flush valve body 601 via arms 605. Openings defined by the flush valve inlet 602, bottom of tubular guide element 604, and arms 605 provide for flow communication of a surrounding fluid, for instance water in a toilet tank, with flush valve inlet 602. Flush valve seal 606 is coupled to rigid linkage 607 on a top face of the flush valve seal; wherein the rigid linkage is configured to lift and to lower the flush valve seal. Rigid linkage 607 is disposed in guide element 604. During operation, a piston (not visible) within cylinder 608 may be moved by fluid pressure from a solenoid tree. Movement of the piston will move rod 609. Rod 609 is coupled to rigid linkage 607, thus, upward vertical movement of rod 609 will lift flush valve seal 606 to open the flush valve and downward movement of rod 609 will lower flush valve seal 606 to close the flush valve. In an embodiment, fluid pressure on a piston may be applied from a solenoid valve to lift rigid linkage 607; and fluid pressure may be relieved from cylinder 608 to a toilet tank, to lower rigid linkage 607.

Figure 7A:
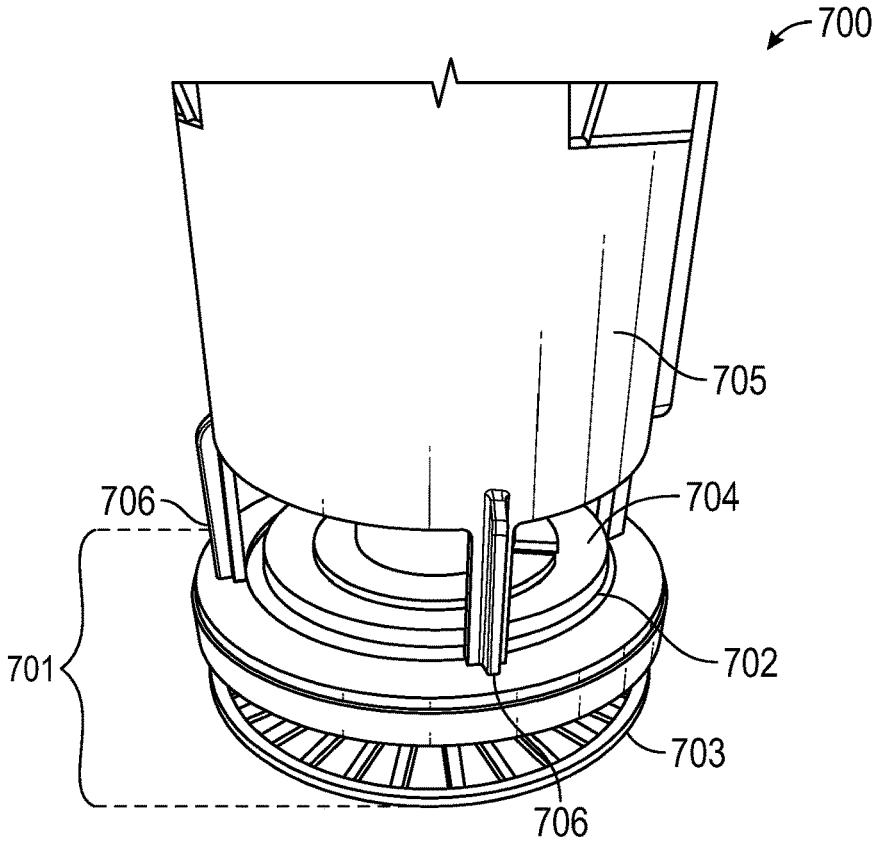
FIG. 7*a* and FIG. 7*b* show a flush valve assembly in a closed and open position, respectively, according to an embodiment.
Figure 7B:
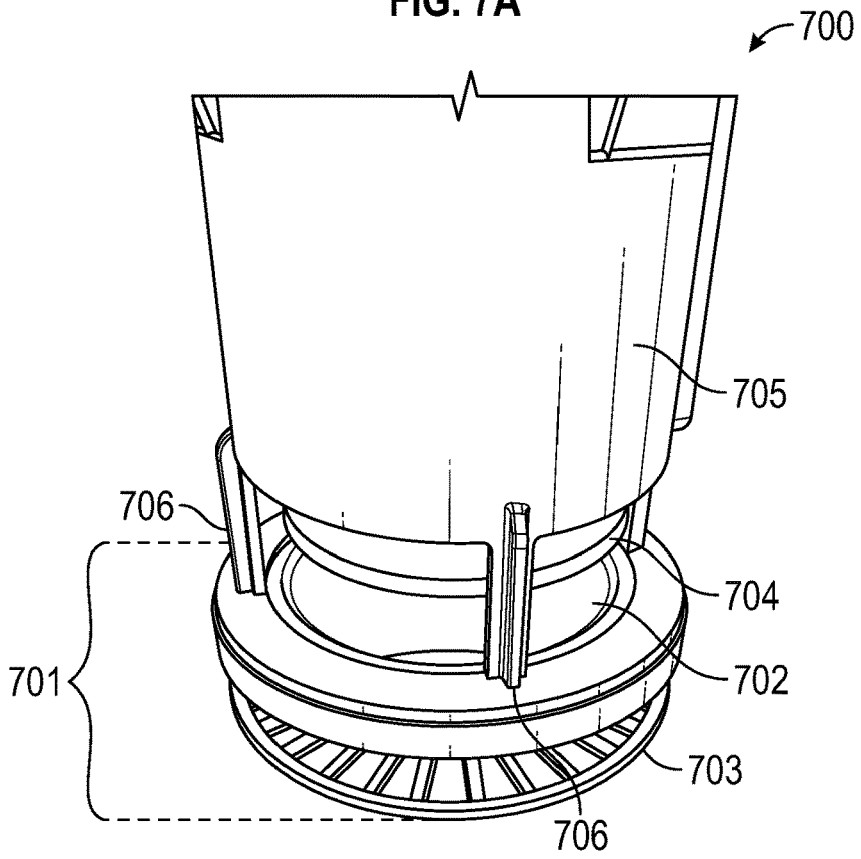

FIG. 7*a* and FIG. 7*b* show flush valve assembly 700 comprising a flush valve body 701 extending from a flush valve inlet 702 to a flush valve outlet 703. The assembly comprises a tubular guide element 705 supported on a flush valve top via arms 706. Arms 706, flush valve body 701, and bottom of guide element 705 define openings configured to provide flow communication of a surrounding fluid, for instance water in a toilet tank, with the flush valve. FIG. 7*a* shows the flush valve assembly 700 in a closed position with flush valve seal 704 enclosing the flush valve inlet 702. FIG. 7*b* shows flush valve assembly 700 in an open position with the flush valve seal 704 lifted away from the flush valve inlet 702, allowing a surrounding fluid to exit through the flush valve and out, for instance to a toilet bowl.

In some embodiments, a flush valve assembly may be configured to perform a clean cycle. Upon initiation of a clean cycle, a flush valve may be opened to an intermediate position. An intermediate flush valve position may be configured to provide a flush volume adequate to clean a bowl but not adequate to initiate a siphon flush. In some embodiments, a clean cycle may comprise a discharge of a cleaning fluid and water through a second flush valve, e.g. a rim flush valve.

Flush valve assemblies of the present disclosure may be enclosed inside any toilet tank. Flush valve assemblies may be made of any type of rigid materials. Flush valve assemblies may include one or more of the following: gear motor(s), pumps, switch(s), hoses, tubing, solenoid valves, PCB, power sources (e.g. batteries), vacuum breaker, liquid level sensor, embedded programs, UI display with buttons/switches/triggers system. There may be two configurations of flush valves, multiple and single valve systems.

Flush valve assemblies may offer unique pre-programmed functions selectable by the user. Such functions may include, electronic control of full & partial flushes, auto-priming, cleaning, foaming, XYZ functions, IOT capabilities. Flush valve assemblies may include a connected version that may be remotely controlled for flushing, cleaning a toilet, sending notification to owners remotely and electronically. Flush valve assemblies may detect a leak by using a touch sensor embedded in chinaware that can detect a leak and clog (e.g. a toilet performance sensor TPS). Flush valve assemblies may have a sensor to detect leaks inside a tank (e.g. a float sensor in tank, using special programming to detect sensor status and apply parameters). Flush valve assemblies may be applied to in-wall gravity tanks.

Flush valve assemblies of the present disclosure may be electro-mechanical flush valve assembly. Flush valve assemblies may control the descent of a sealing surface on flush valve. Flush valve assemblies may be used on single or dual flush systems. Flush valve assemblies may use no floats. Flush valve assemblies may use no chains. Embodiments of flush valve assemblies of the present disclosure allow for various benefits and advantages. For example, controlling the descent of a flush valve(s) allows for optimal control of a flush valve.

Controlling the descent of a flush valve may allow for more accurate water consumption totals, better flush performance, special programmed functions for cleaning, purging, and/or auto-priming. Flush valve assemblies may provide superior water control and/or flush performance. Flush valve assemblies may be highly durable, reliable, well performing, and/or unique flush systems. Flush valve assemblies offer an electronic alternative that may be utilized in either a single or multi-flush valve toilet. Components of flush valve assemblies may be strategically used and placed to offer independent flush valve control, and/or electronic water inlet control. Flush valve assemblies of the present disclosure offer control of specific timing (ascent, descent) of each flush valve seal. This controls a specific proportion of water exiting each flush valve. Since valve control is specific and precise, functionalities such as cleaning functions (e.g. auto-priming, purging, full flush, partial flush, independent valve control) that do not rely on floats may be used with flush valve assemblies of the present disclosure.

Flush valve assemblies of the present disclosure may be provided in urinal gravity flush valve assemblies and/or in-wall installation. Flush valve assemblies may be used in conjunction with a toilet performance system (TPS) to detect clogs, provide feedback remotely, and/or trigger a response to a flush valve. The valve control this system offers may be applied to a bathtub filling system. The valve may control water flow from a reservoir to provide quick filling of a tub. The valve control may be applied to a shower system that needs to supply a large flow of water quickly. The valve control may be applied to other applications where there is a need to supply a large volume of water, via a holding tank, with electronic control.

Flush valve assemblies of the present disclosure may allow for a slower rate of descent. Flush valve assemblies of the present disclosure may allow for a controlled rate of descent. A slower rate of controlled descent may prevent or eliminate abrupt closing of a flush valve. This may reduce water hammer. A slower rate of ascent and/or descent may allow complete control of a flush valve seal which may help reduce consumption volumes, improve the ratio of flow through each of the flush valves, and allow for independent operation of one or more of flush valves. Independent operation of one or more flush valves may also allow performing unique functions dependent upon position of the valve seal while opened and/or closed. A controlled ascent and/or descent of a flush valve may be fast, slow, intermediate speeds, paused, or stopped. The one or more flush valves may be actuated one or more times during a flush or function to offer improved flush performance.

In some embodiments, the fluid flow path from flush valve body inlet to outlet is uniform, that is, the interior shape of the valve inlet body from inlet to outlet, defining the flow path, is uniform. In other embodiments, an inlet may be "radiused" or comprise a "lead-in angle". In some embodiments, a portion of the flush valve body may be downwardly-tapered from inlet to outlet, providing a decreasing valve body diameter along the flow path, that is, providing a decreasing liquid volume flow path (decreasing flow path). In some embodiments, a flush valve body may comprise both a radiused inlet and a downwardly-tapered valve body. The terms "radiused" and "downwardly-tapered" may mean linearly radiused or tapered or, may mean non-linearly radiused or tapered. Flush valves having a radiused inlet and tapered bodies are described for example in U.S. Pat. Nos. 6,715,162, 6,728,975 and 6,901,610 and US2014/0090158.

In some embodiments, a flush valve body that is downwardly-tapered may be generally symmetrical, providing a generally symmetrical decreasing flow path. In other embodiments, a flush valve body that is downwardly-tapered may be non-symmetrical, providing a non-symmetrical decreasing flow path. A flush valve body will also have a front and a back, corresponding to front and a back sections of a flush valve seal. Non-symmetrical tapering may mean a flush valve body front or back is more tapered than the other. Non-symmetrical tapering may mean a liquid flow path is longer in a flush valve body front or back than the other. Another way to describe a non-symmetrical downwardly-tapered flush valve body is that a valve outlet center is not aligned with a valve inlet center along an x-y plane or along an x-z plane. A "center" means a mid-point along a longest diameter. A non-symmetrical flush valve body may be linearly or non-linearly downwardly-tapered. In some embodiments, a non-symmetrical flush valve body may comprise a circular or a non-circular inlet.

A non-symmetrical flush valve body may comprise a symmetrical portion and a non-symmetrical portion. For instance, a flush valve body may comprise a symmetrical, substantially circular (substantially cylindrical) outlet portion and a non-symmetrical downwardly-tapered inlet portion.

Although the foregoing description is directed to the certain embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

Some embodiments of the invention include the following.

In a first embodiment, disclosed is a flush valve assembly comprising a flush valve comprising a flush valve body extending from a flush valve inlet to a flush valve outlet; a flush valve seal having a top face and a bottom face; and a flush actuator comprising a rigid linkage; wherein the bottom face of the flush valve seal is configured to enclose the flush valve inlet; and wherein the rigid linkage is coupled to the top face of the flush valve seal and is configured to lift the flush valve seal to open the flush valve and to lower the flush valve seal to close the flush valve.

In a second embodiment, disclosed is a flush valve assembly according to the first embodiment, wherein the flush valve body is coupled to a guide element, and wherein the rigid linkage is disposed in the guide element. In a third embodiment, disclosed is a flush valve assembly according to the second embodiment, wherein the guide element comprises a body comprising one or more openings configured to provide flow communication of a surrounding fluid with the flush valve inlet.

In a fourth embodiment, disclosed is a flush valve assembly according to the first or second embodiments, wherein the rigid linkage is configured to lift the flush valve seal to partially open the flush valve and to lower the flush valve seal to close the flush valve without fully opening the flush valve. In a fifth embodiment, disclosed is a flush valve assembly according to any of the preceding embodiments, wherein the assembly is configured to provide multiple flush volumes.

In a sixth embodiment, disclosed is a flush valve assembly according to any of the preceding embodiments, wherein the rigid linkage comprises a multi-arm linkage. In a seventh embodiment, disclosed is a flush valve assembly according to embodiment five, wherein the multi-arm linkage comprises one or more joints configured to allow for movement of the multi-arm linkage around the joints.

In an eighth embodiment, disclosed is a flush valve assembly according to any of the preceding embodiments, wherein the rigid linkage is configured to lift the flush valve seal longitudinally from the flush valve inlet. In an ninth embodiment, disclosed is a flush valve assembly according to any of the preceding embodiments, wherein the rigid linkage is substantially perpendicular to the flush valve seal top face.

In a tenth embodiment, disclosed is a flush valve assembly according to any of the preceding embodiments, wherein the valve body inlet is substantially circular. In an eleventh embodiment, disclosed is a flush valve assembly according to any of embodiments one to nine, wherein the flush valve body inlet is triangular, rectangular, square, oval, oblong, ovate, elliptic, obovate, cuneate, deltoid or orbicular.

In a twelfth embodiment, disclosed is a flush valve assembly according to any of the preceding embodiments, wherein the flush valve inlet is radiused. In a thirteenth embodiment, disclosed flush valve assembly according to any of the preceding embodiments, wherein the flush valve body is downwardly-tapered. In a fourteenth embodiment, disclosed is a flush valve assembly according to any of the preceding embodiments, wherein the flush valve body is non-symmetrical.

In a fifteenth embodiment, disclosed is a flush valve assembly according to any of the preceding embodiments, wherein the flush actuator is associated with an electric motor, a hydraulic cylinder, a pneumatic cylinder, a piston, a manual lever, a push button, or a combination thereof.

In a sixteenth embodiment, disclosed is a flush valve assembly according to any of the preceding embodiments, wherein the flush actuator is associated with an electric motor, and wherein the electric motor is associated with a motor wheel, wherein the rigid linkage is coupled to the motor wheel.

In a seventeenth embodiment, disclosed is a flush valve assembly according to embodiment sixteen, wherein the motor wheel has a 12 o'clock position corresponding to a fully open flush valve and a 6 o'clock position corresponding to a fully closed flush valve.

In an eighteenth embodiment, disclosed is a flush valve assembly of embodiment seventeen, wherein the motor wheel has an intermediate position corresponding to a partially-open flush valve, the intermediate position corresponding to degree interval of the motor wheel between the 12 o'clock and 6 o'clock positions.

In a nineteenth embodiment, disclosed is a flush valve assembly of embodiment sixteen, wherein the motor wheel is configured to rotate a degree interval to control a volume of fluid flowing through the flush valve.

In a twentieth embodiment, disclosed is a flush valve assembly according to any of the preceding embodiments, wherein the flush actuator is associated with an electric motor, and wherein the electric motor is in electronic communication with a controller.

In a twenty-first embodiment, disclosed is a flush valve assembly according to embodiment fifteen, wherein the flush actuator is associated with a hydraulic cylinder, and wherein the hydraulic cylinder is in flow communication with a solenoid valve.

In a twenty-second embodiment, disclosed is a flush valve assembly according to embodiment twenty one, wherein the solenoid valve is in electrical communication with a controller.

In a twenty-third embodiment, disclosed is a flush valve assembly according to any of the preceding embodiments, wherein the flush actuator does not comprise a chain.

In a twenty-fourth embodiment, disclosed is a toilet tank comprising the flush valve assembly according to any of the preceding embodiments.

In a twenty-fifth embodiment, disclosed is a toilet comprising the flush valve assembly according to any of embodiments one through twenty-three.

In a twenty-sixth embodiment, disclosed is a toilet according to embodiment twenty-five, wherein the toilet is a non-jetted, rim jetted, or direct jetted gravity powered siphonic toilet.

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" or "fluid communication" means for example configured for liquid or gas flow there through. The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular and "tube-like" means generally shaped like a tube, but not necessarily perfectly cylindrical.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

The invention claimed is:

1. A flush valve assembly comprising a flush valve comprising a flush valve body extending from a flush valve inlet to a flush valve outlet;

a guide element having a plate coupled to a top end thereof;

a flush valve seal having a top face and a bottom face; and a flush actuator comprising a rigid multi-arm linkage coupled to a motor wheel, and an electric motor coupled to the motor wheel, wherein the bottom face of the flush valve seal is configured to enclose the flush valve inlet, the rigid multi-arm linkage is coupled to the top face of the flush valve seal and is configured to lift the flush valve seal to open the flush valve and to lower the flush valve seal to close the flush valve, the rigid multi-arm linkage is configured to rotate along a circular path with the motor wheel to open and close the flush valve, the flush valve body is coupled to the guide element, the rigid multi-arm linkage is disposed in the guide element, the electric motor and the motor wheel are coupled to a top surface of the plate, the plate comprises an opening to accommodate the coupling of the rigid multi-arm linkage to the motor wheel, and the plate opening accommodates the rotation of the multi-arm linkage along the circular path.

2. The flush valve assembly according to claim 1, wherein the guide element comprises a body comprising one or more openings configured to provide flow communication of a surrounding fluid with the flush valve inlet.

3. The flush valve assembly according to claim 1, wherein the rigid multi-arm linkage comprises a slot-and-pin connection.

4. The flush valve assembly according to claim 3, wherein the rigid multi-arm linkage comprises one or more joints configured to allow for movement of the rigid multi-arm linkage around the joints.

5. The flush valve assembly according to claim 1, wherein the rigid multi-arm linkage is configured to lift flush valve seal longitudinally from the flush valve inlet.

6. The flush valve assembly according to claim 1, wherein the rigid multi-arm linkage is perpendicular to the flush valve seal top face.

7. The flush valve assembly according to claim 1, wherein the valve body inlet is circular.

8. The flush valve assembly according to claim 1, wherein the flush valve body inlet is triangular, rectangular, square, oval, oblong, ovate, elliptic, obovate, cuneate, deltoid or orbicular.

9. The flush valve assembly according to claim 1, wherein the flush valve inlet is radiused.

10. The flush valve assembly according to claim 1, wherein the flush valve body is downwardly-tapered.

11. The flush valve assembly according to claim 1, wherein the flush valve body is non-symmetrical.

12. The flush valve assembly according to claim 1, wherein the rigid multi-arm linkage is configured to lift the flush valve seal and to lower the flush valve seal at a controlled rate to control a flush volume.

13. The flush valve assembly of claim 1, wherein the motor wheel is configured to rotate a degree interval to control a flush volume.

14. The flush valve assembly according to claim 1, wherein the electric motor is in electronic communication with a controller configured to actuate the electric motor to rotate the motor wheel.

15. The flush valve assembly according to claim 1, wherein the rigid multi-arm linkage is configured to lift the flush valve seal to partially open the flush valve and to lower the flush valve seal to close the flush valve without fully opening the flush valve.

16. The flush valve assembly according to claim 1, wherein the assembly is configured to provide multiple flush volumes.

17. A toilet comprising the flush valve assembly according to claim 1.

* * * * *